United States Patent [19]

Ritten

[11] Patent Number: 4,765,438

[45] Date of Patent: Aug. 23, 1988

[54] BOAT PLATFORM LADDERS

[75] Inventor: Robert G. Ritten, Ft. Pierce, Fla.

[73] Assignee: Step-On Inc., Ft. Pierce, Fla.

[21] Appl. No.: 77,446

[22] Filed: Jul. 24, 1987

[51] Int. Cl.[4] ..... B63B 29/20

[52] U.S. Cl. ..... 182/84; 182/91; 441/39

[58] Field of Search ..... 182/91, 97, 84, 85; 280/166; 441/39; 114/362

[56] References Cited

U.S. PATENT DOCUMENTS

| | | | |
|---|---|---|---|
| 3,195,680 | 7/1965 | Thornburg | 182/92 |
| 3,601,220 | 8/1971 | Saucier | 182/84 |
| 3,774,720 | 11/1973 | Hovey | 182/88 |
| 4,462,485 | 7/1984 | Terry et al. | 182/91 |

*Primary Examiner*—Reinaldo P. Machado

*Attorney, Agent, or Firm*—Carroll F. Palmer

[57] ABSTRACT

Platform and ladder combinations for the transom of a boat have a platform unit and a step unit that may be moved between a use position with a step thereof immersed in the water in which the boat floats and a storage position where the step is located above the platform out of the water, which step in the use position extends aft of the platform unit and permits a person to climb out of the water and onto the platform without the step making any appreciable movement during such climb. The platform unit has a pair of tubular members with an inboard portion, a U-shaped outboard portion, a central portion and planking attached to the central portion of each the tubular members holding them spaced apart. The step unit is a tubular member defined by a middle section, two parallel, spaced apart end sections and planking fixed to short legs of the end sections forming a step. The end sections of the step unit are hinged to the tubular members of the platform unit adjacent a corner of its U-shaped outboard portions and the unattached ends of such portions act to limit the descent of the step unit when it is lowered into the use position.

6 Claims, 1 Drawing Sheet

BOAT PLATFORM LADDERS

BACKGROUND OF THE INVENTION

1. Field of the Invention

This invention relates broadly to boarding devices for boats. More particularly, it concerns platform and ladder combinations for mounting on the transom of a boat so the ladder may be moved between a use position wherein a step thereof is immersed in the water in which the boat floats and a storage position wherein the step is located above the platform out of the water, which step when in the use position permits a person to climb out of the water and onto the platform without the step making any appreciable movement during such climb.

2. Description of the Prior Art

A variety of platform and step devices have been developed and marketed for attachment to the transoms of boats to assist in boarding or debarking the boats or to help in moving or working about the stern of the boats. These prior devices can be divided broadly into three classes, i.e., (1) those that are strictly ladders and provide no real platform function (see U.S. Pat. No. 3,774,720), (2) those that are strictly platforms and (3) those that provide combination step and platform functions (see U.S. Pat. Nos. 3,195,680 and 4,462,485). The present invention relates the devices of the third type.

In the devices of the third type in the prior art there is typically a platform that attaches to the boat transom plus some form of depending step arrangement that assists the user of the device to lower or raise his body upon one or more steps positioned at a level below the platform. In some forms of such devices, the depending step or steps are fixed immoveably to the platform while in others the step or steps are hinged or otherwise arranged to move between a lowered, use position and a raised, storage position. The present invention concerns boat ladder devices of the moveable step type.

The prior art devices of the type to which the present invention relates as stated above have some undesirable aspects. For example, many such type prior art devices have a moveable step section mounted to the platform section in a manner that the step section is not sturdily fixed when in the lowered, use position with the result that the user has difficulty in lifting his body on an unsteady step. This is particularly bothersome when the user is carrying heavy gear, e.g., scuba gear, since the added weight serves to aggravate the unstable conditions. The present invention provides a solution to this type of boat step problem.

OBJECTS

A principal object of the invention is to provision of improved forms of step devices for attachment to transom platforms on boats.

Further objects include the provision of:

1. Combination platform/ladders for boats having moveable step sections in which the step section when in the lowered, use position is fixed against swinging or other movement relative to the platform to which attached so a user is presented with steady step or steps upon which to lift his body and any gear that he carries.

2. New boat ladder-platform combinations having improved safety and function features.

3. Such devices structured to reduce material and labor costs in their manufacture.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

The objects are accomplished, in part, in accordance with the invention by the provision of platform and ladder combinations for the transom of a boat having a platform unit, mounting means for supporting the platform unit on a boat transom and a step unit that may be moved between a use position with a step thereof immersed in the water in which the boat floats and a storage position where the step is located above the platform out of the water, which step in the use position extends aft of the platform unit and permits a person to climb out of the water and onto the platform unit without the step making any appreciable movement relative to the platform unit during such climb.

The platform unit comprises a pair of spaced apart, tubular members having an inboard portion, an outboard portion and a central portion integrally joining the inboard portion to the outboard portion. The inboard portions are defined by a length of tubing having a first section attached at one end to the central portion by a substantially right angle elbow and a second section integral with the first section, there being a slight bend in the length of tubing at the junction between the first and second sections.

The outboard portions are defined by a U-shaped length of tubing attached at one end to the central portion so that the inboard portion and the outboard portion lie on the same side of the central portion and in a common plane with the unattached end of the U-shaped length of tubing extending toward the inboard portion and terminating a substantial distance from the inboard portion.

There is planking attached to the central portion of each the tubular members holding them spaced apart and with the inboard and the outboard portions thereof extending away from the planking.

The step unit comprises a tubular member defined by a middle section and two parallel end sections integral with the middle section disposed in planes substantially perpendicular to the middle section.

The end sections are substantially identical and have a first short leg joined at one end to the middle section, a long leg joined at one end to the other end of the first short leg and a second short leg joined at one end to the other end of the long leg. All the legs of each end section lie in one plane with the long leg being approximately perpendicular to the first short leg and the second short leg extending from the long leg at an acute angle toward the first short leg.

The end sections are spaced apart approximately the distance between the tubular members of the platform unit and planking is fixed to the second short legs of the end sections spanning the distance between them and forming a step.

The end sections of the step unit are hinged to the U-shaped portions of the tubular members adjacent the corner where the first short leg in the end sections joins the respective long leg whereby the lower unit may be moved between a raised position where the step is positioned above the platform and a lowered position where the step is positioned below and astern of the platform. The unattached ends of the U-shaped length of tubing in the platform unit serve to engage the middle section of the step unit when the step unit is in the lowered position to limit the downward movement of the step unit in the lowered position.

In a preferred embodiment, a brace strap is fixed at one end to the second section of the inboard portion and its other end is fixed to the central portion of the platform unit tubular members. Also, the mounting means for the platform unit advantageously is a pair of saddle brackets and the elbows of such tubular members are hinged to such brackets.

BRIEF DESCRIPTION OF THE DRAWINGS

A more complete understanding of the invention may be had by reference to the accompanying drawings in which.

DESCRIPTION OF THE PREFERRED EMBODIMENTS

Figure 1:
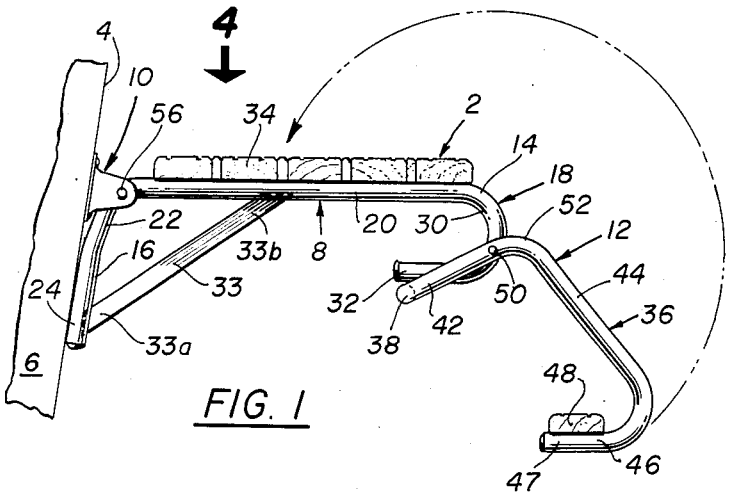
FIG. 1 is a lateral view of a first embodiment of a boat platform ladder in accordance with the invention with its step unit in the lowered, use position.

Referring in detail to the drawings, in which identical parts are identically marked, the invention concerns a platform and ladder combination 2 for the transom 4 of a boat 6 comprising a platform unit 8, mounting means 10 for supporting the platform unit 8 on transom 4 and a step unit 12.

The platform unit 8 comprises a pair of tubular members 14 having an inboard portion 16, an outboard portion 18 and a central portion 20.

The inboard portion 16 is a length of tubing having a first section 22 attached at one end to the central portion 20 by a substantially right angle elbow 24 and a second section 26 integral with the first section 22. There is a slight bend in the tubing at the junction 28 between the first and second sections 22 and 26 respectively.

Figure 3:
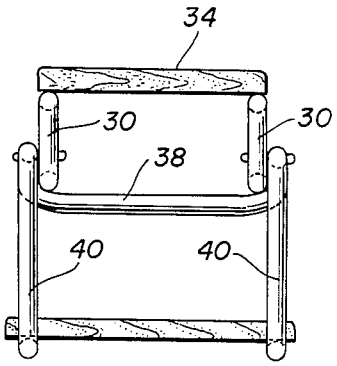
FIG. 3 is an end view of a boat platform ladder in accordance with the invention.
Figure 2:
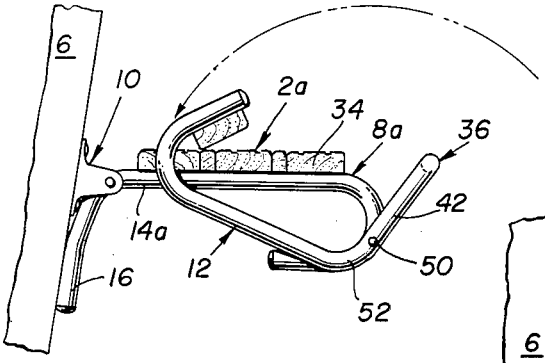
FIG. 2 is a lateral view of a second embodiment of a boat platform ladder in accordance with the invention with its step unit in the raised, storage position.
Figure 4:
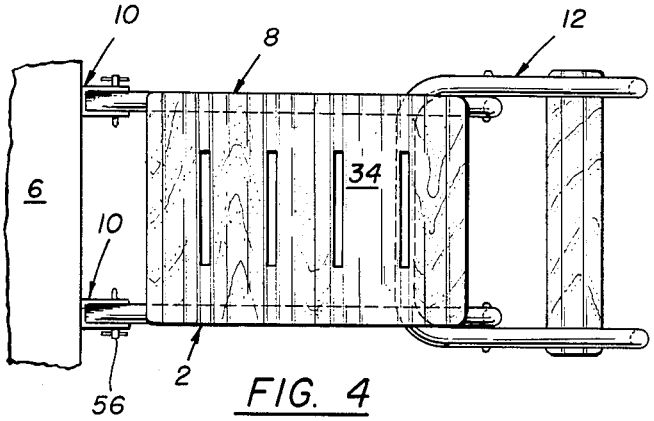
FIG. 4 is a plan view of the boat platform ladder shown in FIG. 1.
Figure 5:
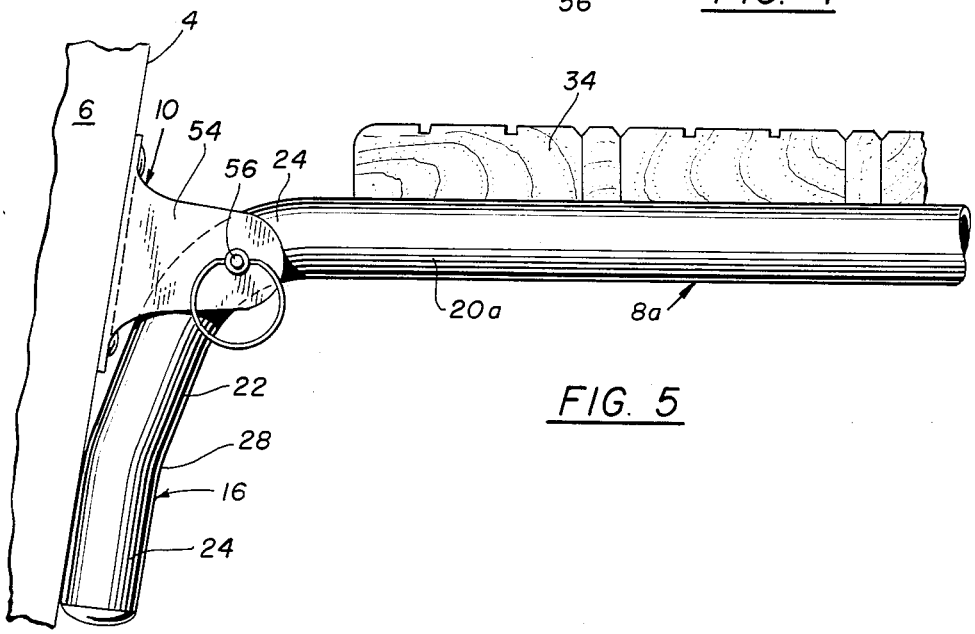
FIG. 5 is an enlarged, fragmentary view of the inboard portion of the boat platform ladder shown in FIG. 2.

The outboard portion 18 is defined by a U-shaped length of tubing 30 attached at one end to the central portion 20 so that the inboard portion 16 and the outboard portion 18 lie on the same side of the central portion 20 and in a common plane (see FIG. 3). The unattached end 32 of the U-shaped length of tubing 30 extends toward the inboard portion and terminates a substantial distance from the inboard portion 16.

In each tubular member 14, a brace strap 33 is fixed at one end **33*a* to the second section 24 and its other end 33*b* is fixed to the central portion 20 of the platform unit tubular member 14**.

Planking 34 is attached to the central portion of each of the tubular members 14 holding them spaced apart and with the inboard and the outboard portions thereof extending away from the planking 34.

The step unit 12 comprises a tubular member 36 defined by a middle section 38 and two parallel end sections 40 integral with the middle section 38 disposed in planes substantially perpendicular to the middle section 38.

The end sections 40 are substantially identical and comprise a first short leg 42 joined at one end to the middle section 38, a long leg 44 joined at one end to the other end of the first short leg 42 and a second short leg 46 joined at one end to the other end of the long leg 44 leaving an unattached end 47. All the legs of each end section lie in one plane (see FIG. 3) with the long leg 44 being approximately perpendicular to the first short leg 42 and the second short leg 46 extending from the long leg 44 at an acute angle toward the first short leg 42.

The end sections 40 are spaced apart approximately the distance between the tubular members 14 of the platform unit 8 and planking 48 is fixed to the second short legs 46 forming a step.

The end sections 40 of the step unit are hinged by pins 50 to the U-shaped portions 30 of the tubular members 14 adjacent the corner 52 where the first short leg 42 in the end sections 40 joins the respective long leg 44. The unattached ends 32 of the U-shaped length of tubing 30 serve to engage the middle section 38 of the step unit 12 when it is in the lowered position (see FIGS. 1 and 3) to limit the downward movement of the step unit 12 in the lowered position.

The mounting means 10 for the platform unit 8 is a pair of saddle brackets 54 to which the elbows 24 of such tubular members 14 are hinged by fastpins 56.

The second embodiment **2*a* of the new platform ladders is like the first embodiment 2 except that the central portion 20*a* of the tubular members 14*a* in the platform unit 8*a* is shorter that the central portion 20 of unit 8 and the unit 8*a* contains no corner brace 33**.

The embodiments of the invention in which an exclusive property or privilege is claimed are defined as follows:

1. In a platform and ladder combination for the transom of a boat having a platform unit, mounting means for supporting said platform unit on a boat transom and a step unit that may be moved between a use position with a step thereof immersed in the water in which the boat floats and a storage position where said step is located above said platform out of said water, which step in said use position extends aft of said platform unit and permits a person to climb out of said water and onto said platform unit without said step making any appreciable movement relative to said platform unit during such climb, the improvement wherein:

said platform unit comprises:

a pair of spaced apart, tubular members having an inboard portion, an outboard portion and a central portion integrally joining said inboard portion to said outboard portion, said inboard portion being defined by a length of tubing having a first section attached at one end to said central portion by a substantially right angle elbow and a second section integral with said first section, there being a slight bend in said length of tubing at the junction between said first and second sections, said outboard portion being defined by a U-shaped length of tubing having a first end attached to said central portion and second unattached end so that said inboard portion and said outboard portion lie on the same side of said central portion and in a common plane with said unattached end of said U-shaped length of tubing extending toward said inboard portion and terminating a substantial distance from said inboard portion, and planking attached to said central portion of each said tubular member holding them spaced apart and with said inboard and said outboard portions thereof extending away from said planking, and said step unit comprises:

a tubular member defined by a middle section and two parallel end sections integral with said middle section disposed in planes substantially perpendicular to said middle section, said end sections being substantially identical and comprising a first short leg joined at one end to said middle section, a long leg joined at one end to the other end of said first short leg and a second short leg joined at one end to the other end of said long leg, all said legs of each end section lying in one plane with said long leg being approximately perpendicular to said first short leg and said second short leg extending from said long leg at an acute angle toward said first short leg, said end sections being spaced apart approximately the distance between said tubular members of said platform unit and planking fixed to said second short legs of said end sections spanning the distance between them and forming a step, said end sections of said step unit being hinged to said U-shaped portions of said tubular members adjacent the corner where said first short leg in said end sections joins the respective long leg whereby said lower unit may be moved between a raised position where said step is positioned above said platform and a lowered position where said step is positioned below and astern of said platform, said unattached ends of said U-shaped length of tubing serving to engage said middle section of said step unit when said step unit is in said lowered position to limit the downward movement of said step unit in said lowered position.

2. The platform and ladder combination of claim 1 wherein said planking is wood.

3. The platform and ladder combination of claim 1 wherein said planking is metal.

4. The platform and ladder combination of claim 1 wherein said tubular members are all formed from a length of tubing bent into shape.

5. The platform and ladder combination of claim 1 wherein each of said tubular members has a brace strap fixed at one end to said second section of said inboard portion and its other end to said central portion of the tubular member.

6. The platform and ladder combination of claim 1 wherein said mounting means comprises a pair of saddle brackets and said tubular members are hinged to said brackets at said elbows in said tubular members.

* * * * *